US007427035B2

(12) United States Patent
Farrington et al.

(10) Patent No.: US 7,427,035 B2
(45) Date of Patent: Sep. 23, 2008

(54) RAIL DAMPER

(75) Inventors: David Farrington, Penrith (GB); Christopher John Cedric Jones, Romsey (GB)

(73) Assignee: Corus UK Limited, London (GB)

( * ) Notice: Subject to any disclaimer, the term of this patent is extended or adjusted under 35 U.S.C. 154(b) by 0 days.

(21) Appl. No.: 10/547,786

(22) PCT Filed: Feb. 27, 2004

(86) PCT No.: PCT/GB2004/000822

§ 371 (c)(1),
(2), (4) Date: Sep. 21, 2006

(87) PCT Pub. No.: WO2004/079096

PCT Pub. Date: Sep. 16, 2004

(65) Prior Publication Data

US 2007/0034707 A1 Feb. 15, 2007

(30) Foreign Application Priority Data

Mar. 5, 2003 (GB) ..... 0304997.0

(51) Int. Cl.
*E01B 19/00* (2006.01)

(52) U.S. Cl. ..... 238/382

(58) Field of Classification Search ..... 238/382, 238/14.14, 278, 280, 283, 292, 312
See application file for complete search history.

(56) References Cited

U.S. PATENT DOCUMENTS 208,880 A * 10/1878 Atwood ..... 238/283
5,165,598 A 11/1992 Ortwein
6,390,382 B1 * 5/2002 Hodgson et al. ..... 238/382
6,402,044 B1 6/2002 Sato

FOREIGN PATENT DOCUMENTS

| | | |
|---|---|---|
| AT | 399 522 | 5/1995 |
| DE | 36 05 831 | 8/1987 |
| DE | 36 31 492 | 3/1988 |
| EP | 0 628 660 | 12/1994 |
| EP | 1 186 710 | 3/2002 |
| JP | 11-172603 | 6/1999 |
| WO | WO 99/15732 | 4/1999 |

* cited by examiner

*Primary Examiner*—Mark T Le
(74) *Attorney, Agent, or Firm*—Bacon & Thomas, PLLC.

(57) ABSTRACT

A rail damper including an elongate damping device and a clip for supporting the damping device, the clip having a retention aperture for receiving part of the rail and, further, a recess adapted to receive the damper. This is particularly (although not exclusively) suited to dampers in which an elongate hollow rigid section encloses a deformable material in which is suspended one or more resonant members. The clip can be adapted to fit around the foot of the rail. It can include one or more tongues extending alongside the web of the rail. This will assist in separating the damper from the web while still allowing vibrations to be conducted from one to the other. The tongues can be any suitable height, for example the full height of the web, or the full height of the dampers, or less than one or other such heights. Additionally, a damper for a rail is disclosed, which includes an elongate hollow rigid section enclosing a deformable material in which is suspended at least two resonant members, the resonant members being sized to exhibit a resonant frequency in the range of vibration frequencies of the rail.

7 Claims, 1 Drawing Sheet

RAIL DAMPER

FIELD OF THE INVENTION

The present invention relates to a rail damper.

BACKGROUND ART

The noise emitted by moving rail vehicles is a major limitation on their use, in that it will limit the ability of operators to install new lines in populated areas, and will limit speeds and traffic volumes on existing lines. The noise tends to be dominated by rolling noise from the wheel/rail interface, which is caused partly by vibration of the wheels and partly by vibration of the track.

It is not possible to select alternative materials, etc, for these elements since they are subject to very high transient loads during use, and must withstand these. Materials that would be able to absorb vibration and hence reduce noise would be unable to survive in use for any appreciable time. Resilient rail fastenings have been employed to reduce track forces and thereby reduce component damage and structure-borne noise. However, they have an adverse effect on track noise, as they tend to reduce the attenuation of rail vibration.

EP628,660 A1 discloses a rail bar in which a body of high specific mass is arranged within a mouldable material of low specific mass.

Our previous application WO99/15732 discloses a rail damper adapted to absorb a wide range of resonant frequencies in the rail through the use of a damper with resonant members tuned to two frequencies in the spectrum of noise to be absorbed.

SUMMARY OF THE INVENTION

The present invention therefore provides a rail damper comprising an elongate damping means and a clip for supporting the damping means, the clip having a retention aperture for receiving part of the rail and, further, a recess adapted to receive the damper.

The damper can be any suitable rail damper, but the invention is particularly (although not exclusively) suited to dampers in which an elongate hollow rigid section encloses a deformable material in which is suspended one or more resonant members.

The clip can be adapted to fit around the foot of the rail. It can include one or more tongues extending alongside the web of the rail. This will assist in separating the damper from the web while still allowing vibrations to be conducted from one to the other. The tongues can be any suitable height, for example the full height of the web, or the full height of the dampers, or less than one or other such heights.

The present invention also relates, independently, to a damper for a rail comprising an elongate hollow rigid section enclosing a deformable material in which is suspended at least two resonant members, the resonant members being sized to exhibit a resonant frequency in the range of vibration frequencies of the rail.

It is preferred, in this aspect and the first aspect of the invention, that the deformable material fills the space within that rigid hollow section.

The present invention also relates to a rail to which any one of the clips and/or the dampers set out above are attached.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
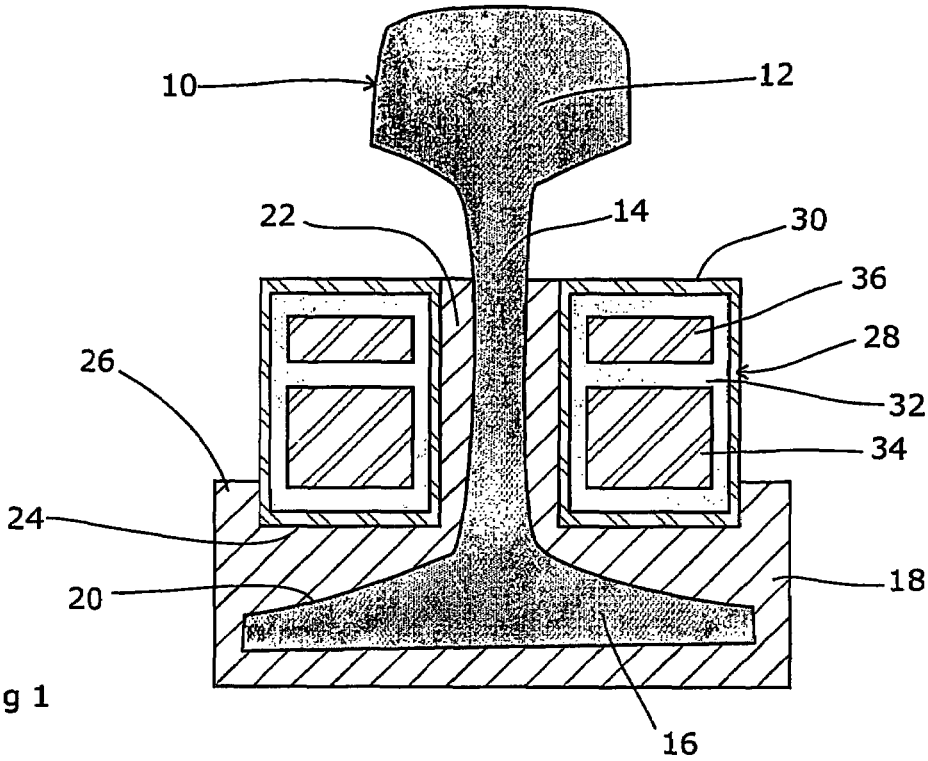
FIG. 1 shows a first embodiment.

Referring to FIG. 1, a rail 10 consists of a head portion 12, a web 14 and a foot 16. Around the foot is a nylon clip 18 which has a dovetailed aperture marked 20, within which the foot 16 of the rail 10 fits. Tongues 22 extend upwardly either side of the web 14. Adjacent the tongues 22 is a generally horizontal flat portion 24 bounded at one end by a short upwardly directed ridge 26. Thus, between the tongues 22 and the ridges 26 there are defined a pair of recesses for receiving the damper. The damper 28 comprises an elongate hollow rigid steel section 30 which (in this embodiment) is rectangular in form. Within the box section 30, a deformable material of a rubber or rubber-like material 32 fills the interior space except for a pair of resonant dampers 34, 36 which are suspended within the deformable material 32. A like damper is disposed on the opposite side of the rail.

Specific dimensions shown in FIG. 1 could be varied at will. For example, the tongues 22 could be made taller or shorter, for example level with the outer ridges 26 or any design height.

Figure 2:
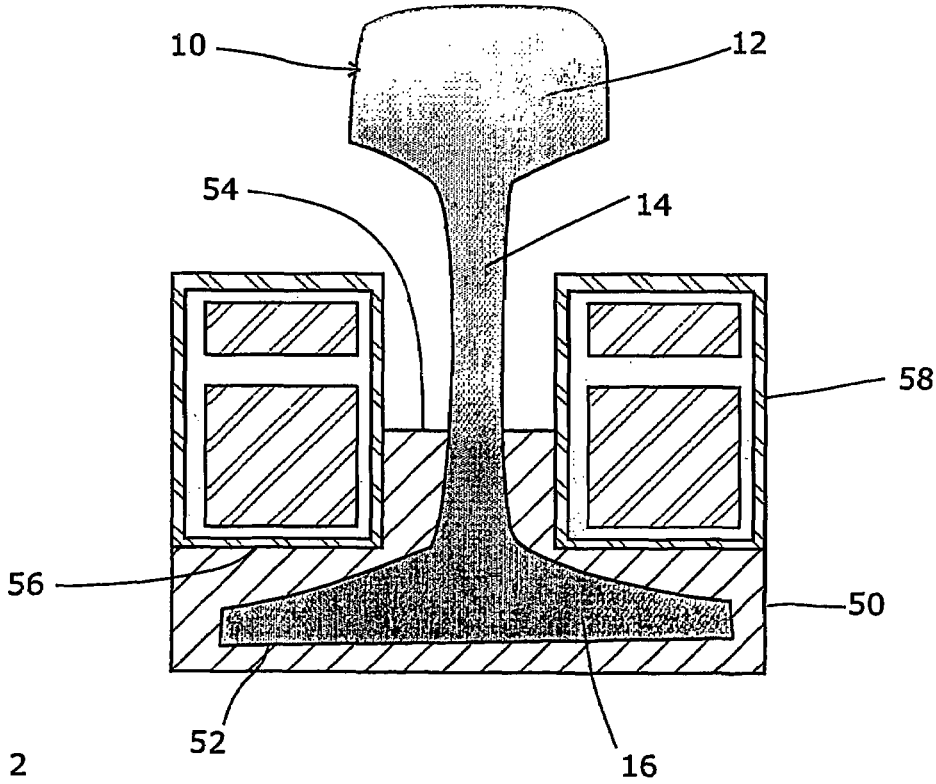
FIG. 2 shows a second embodiment.

Referring to FIG. 2, a similar rail 10 is provided with an alternative clip 50 which has a dove-tail aperture 52 for receiving the foot 16 of the rail 10 and shorter tongues 54 which extend part way up the web 14. A generally horizontal flat portion 56 is also provided and a pair of damper 58 of similar construction to the number in FIG. 1 rests in the L-shaped recess defined by the outer surfaces of the fingers 54 and the flat surface 56.

It will of course be understood that many variations may be made to the above-described embodiment without departing from the scope of the present invention.

The invention claimed is:

1. A rail damper comprising an elongate damping means comprising a deformable material in which is suspended one or more resonant members and a clip supporting the damping means, in which the clip has a retention aperture configured to fit part of a rail and, further, a recess receiving the damping means, said clip being configured, when in use, to contact at least a portion of a rail web, and the damping means further comprising an elongate hollow rigid section enclosing the deformable material.

2. A rail damper according to claim 1, in which the clip is adapted to fit around the foot of the rail.

3. A rail damper according to claim 2 in which the clip includes one or more tongues extending alongside a web section of the rail.

4. A rail damper according to claim 3 in which the height of the tongues is not greater than the height of the web section of the rail.

5. A rail damper according to claim 3 in which the height of the tongues is not greater than the height of the damping means.

6. A damper according to claim 1 in which the deformable material fills the space within said rigid hollow section.

7. A rail, to which a damper according to claim 1 is attached.

US 7,427,035 B2
3 4

* * * * *